US005634825A

United States Patent [19]

Maki

[11] Patent Number: 5,634,825

[45] Date of Patent: Jun. 3, 1997

[54] ELECTRICAL TERMINAL

[75] Inventor: Toshihiro Maki, Shizuoka-ken, Japan

[73] Assignee: Yazaki Corporation, Tokyo, Japan

[21] Appl. No.: 493,613

[22] Filed: Jun. 22, 1995

[30] Foreign Application Priority Data

Jun. 27, 1994 [JP] Japan ..... 6-144240

[51] Int. Cl.[6] ..... H01R 13/54

[52] U.S. Cl. ..... 439/745; 439/748; 439/845

[58] Field of Search ..... 439/745, 746, 439/748, 843, 845, 846

[56] References Cited

U.S. PATENT DOCUMENTS

| | | | |
|---|---|---|---|
| 3,059,216 | 10/1962 | Cunningham | 439/745 |
| 3,874,763 | 4/1975 | Hoover | 439/746 |
| 4,220,388 | 9/1980 | Dechelette | 439/748 |
| 4,238,140 | 12/1980 | Cairns et al. . | |
| 4,416,504 | 11/1983 | Sochor | 439/746 |
| 4,550,972 | 11/1985 | Romak | 439/843 |
| 4,891,017 | 1/1990 | Kuhn et al. | 439/746 |
| 5,094,636 | 3/1992 | Zinn et al. . | |
| 5,108,318 | 4/1992 | Sakurai et al. | 439/843 |
| 5,362,262 | 11/1994 | Hotea | 439/846 |
| 5,415,571 | 5/1995 | Lutsch | 439/843 |
| 5,419,723 | 5/1995 | Villiers et al. | 439/843 |

FOREIGN PATENT DOCUMENTS

| | | | |
|---|---|---|---|
| 4131470 | 4/1993 | Germany | 439/745 |

*Primary Examiner*—Gary E. Elkins

*Attorney, Agent, or Firm*—Oblon, Spivak, McClelland, Maier & Neustadt, P.C.

[57] ABSTRACT

An electrical terminal to be inserted into a terminal receiving chamber of a connector housing is provided. The terminal includes a terminal body which can be provided by folding a conductive metal plate and a protective cover made of synthetic insulating material to cover the terminal body. The protective cover is provided on a rear side thereof with a flexible engagement piece having an engagement projection by which the terminal can be engaged in the connector housing.

6 Claims, 4 Drawing Sheets

ELECTRICAL TERMINAL

BACKGROUND OF THE INVENTION

The present invention relates to an electrical terminal engaged in a terminal receiving chamber of a connector housing and used for connection of an electrical circuit.

Recently, in connection with complication and high densification of the electrical circuit, there has been desired a miniaturization and multipolarization of a connector. From this point of view, there has been proposed an arrangement for miniaturizing the connector housing, as follows. In the arrangement, an engagement piece such as a lance or an arm is provided on the terminal to be engaged in the terminal receiving chamber of the connector housing, so that the engagement piece is engaged with an engagement part provided in the terminal receiving chamber.

U.S. Pat. No. 5,094,636 discloses the above-mentioned terminal. The terminal has raised pieces formed on sidewalls thereof. In using, the terminal having a wire connected thereto is inserted into a connector housing so that the raised pieces are engaged with engagement projections formed in a terminal receiving chamber.

With the arrangement mentioned above, however, the raised pieces are apt to be deformed by an external force during manufacturing a wire harness or transporting the terminal because of their projecting configuration. Consequently, the raised pieces may be folded or depressed, so that the terminal cannot be engaged in the connector housing and the workability of assembling process would grow worse.

SUMMARY OF THE INVENTION

It is therefore an object of the present invention to provide a terminal of high reliability, by which a structure of the terminal receiving chamber can be simplified and which can be securely engaged in the terminal receiving chamber and which is convenient to miniaturize the connector and manufacture a connector of high-density.

The object of the invention described above can be accomplished by an electrical terminal to be inserted into a terminal receiving chamber of a connector housing, the electrical terminal comprising:

a terminal body provided by folding a conductive metal plate, a protective cover arranged to cover the terminal body, the protective cover being made of insulating material and having one opening end through which the terminal body is to be inserted, and at least one flexible engagement piece defined by two parallel slits which are formed on the protective cover to terminate at one opening end of the protective cover, the flexible engagement piece having an engagement projection by which the electrical terminal can be engaged in the connector housing.

With the arrangement mentioned above, since the the flexible engagement piece is provided on the protective cover for covering the terminal body, the durability and reliability of the piece can be remarkably improved in comparison with the conventional flexible piece provided by raising a part of the terminal body, so that the terminal can be securely engaged with the terminal receiving chamber of the connector housing. In addition, owing to the arrangement separated from the terminal body, it is possible to prevent the flexible engagement piece from being deformed by an external force caused in process of assembling the terminal with the connector housing or process of transporting the terminal body thereby, whereby a number of defective terminals can be reduced and the reliability can be improved. Further, since the structure of the terminal receiving chamber can be simplified corresponding to the terminal of the present invention, the connector housing can be miniaturized and manufactured to be of high-density.

More preferably, the terminal body comprises an electrical contact portion consisting of opposing elastic pieces and wherein the electrical contact portion is covered with the protective cover.

It is also preferable that the electrical terminal of the invention further comprises one flexible engagement piece formed on the protective cover and that the flexible engagement pieces are positioned on top and bottom walls of the protective cover, respectively.

In the arrangement mentioned above, preferably, the protective cover is provided with an opening through which a terminal in the other party is to be inserted into the electrical contact portion.

More preferably, the protective cover is provided on an interior wall thereof with a protrusion and the terminal body is provided with an aperture for engagement with the protrusion.

It is also preferable that the protective cover is made of synthetic resin.

These and other objects and features of the present invention will become more fully apparent from the following description and appended claims taken in conjunction with the accompanying drawings.

DESCRIPTION OF THE PREFERRED EMBODIMENT

One embodiment of the present invention will now be described with reference to the accompanying drawings hereinafter.

Figure 1:
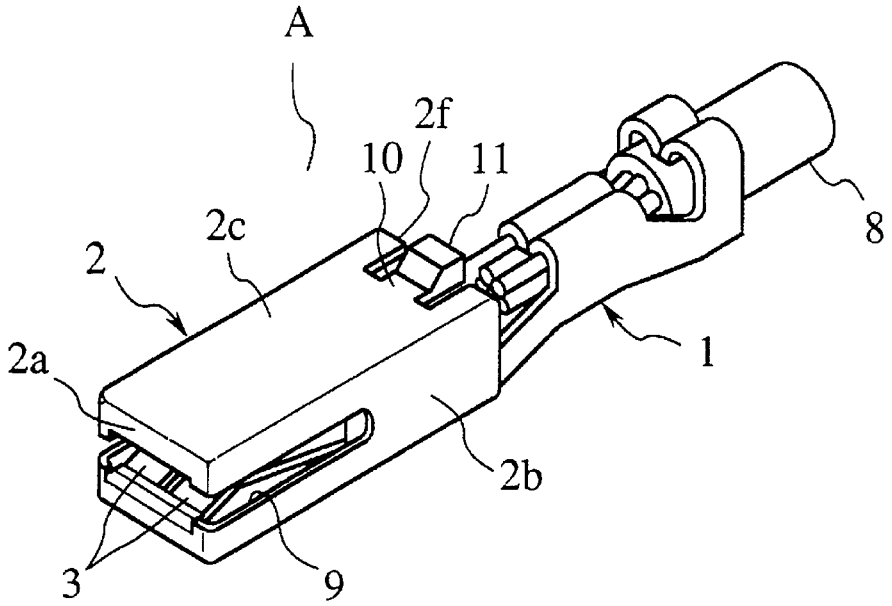
FIG. 1 is a perspective view showing a terminal in accordance with an embodiment of the present invention.
Figure 2:
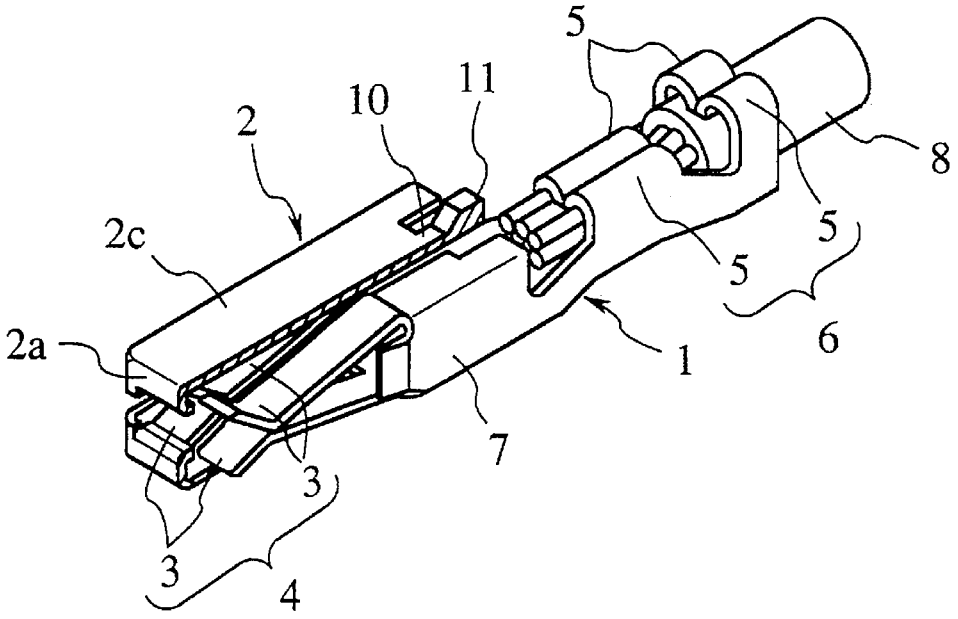
FIG. 2 is a perspective view showing an essential part of the terminal of FIG. 1, in which a part of a protective cover thereof is cut away.
Figure 3:
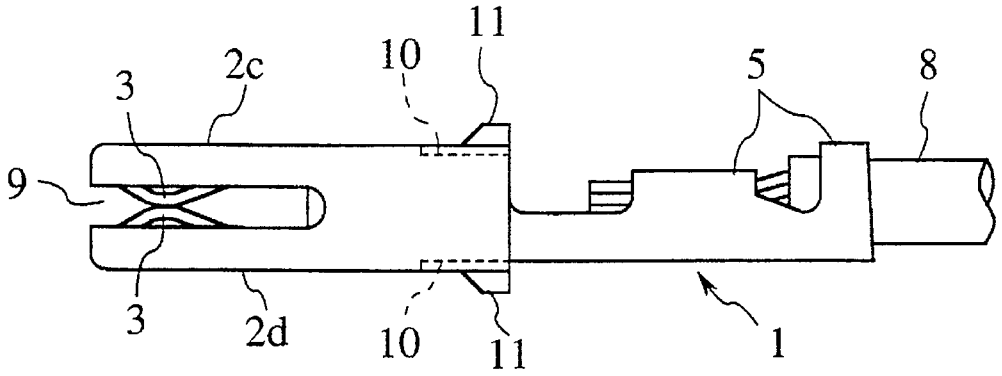
FIG. 3 is a front view of the terminal of FIG. 1.
Figure 4:
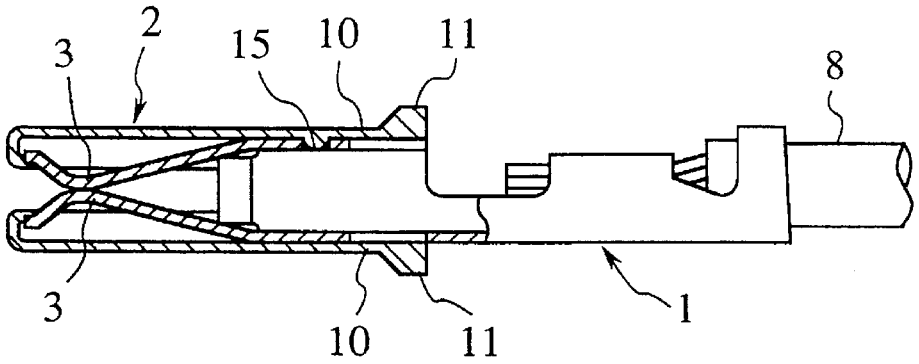
FIG. 4 is a partially cross sectional view of FIG. 1, showing an interior of the protective cover of FIG. 3.

FIG. 1 is a perspective view showing an electrical terminal A in accordance with an embodiment of the present invention, in which an electrical wire is connected to the terminal A. In addition, FIG. 2 is also a perspective view showing the terminal A, in which a part thereof is cut-away to show the interior structure. FIG. 3 is a side view of the terminal A of the invention and FIG. 4 is a partial cross sectional view of FIG. 3.

As shown in these figures, the electrical terminal A of the invention consists of a terminal body 1 and an insulating protective cover 2. The terminal body 1 is provided by folding a conductive metal plate.

On a front side of the terminal A, the terminal body 1 includes an electrical contact portion 4 which consists of two pairs of opposing elastic pieces 3, 3. On the other hand, the terminal body 1 is provided on a rear side thereof with a conductor contact portion 6 having crimping pieces 5, 5. Further, at an intermediate position of the terminal A, the terminal body 1 further includes a frame-shaped coupling portion 7 arranged between the electrical contact portion 4 and the conductor contact portion 6. In FIGS. 1 and 2, there are shown respective conditions under which an electrical wire 8 is crimped by the crimping pieces 5, 5.

By molding of synthetic material of electrical insulation, the protective cover 2 is shaped to have a rectangular cross section so as to fit the coupling portion 7 of the terminal body 1, covering the electrical contact portion 4 thereof. The protective cover 2 is provided on a rear side thereof with an opening end 2*f* through which the terminal body 1 is to be inserted. On the opposite side of the opening end 2*f*, the protective cover 2 has a further opening 9 through which a not-shown terminal (male terminal) in the other party is to be inserted into the terminal A. As shown in FIG. 1, the opening 9 is formed so as to extend from a front wall 2*a* of the protective cover 2 through both sidewalls 2*b*, 2*b* thereof.

In the vicinity of the opening end 2*f* of the protective cover 2, it further includes flexible engagement pieces 10, 10 arranged on a top wall 2*c* and a bottom wall 2*d*, respectively. The flexible engagement pieces 10, 10, each of which is defined by two parallel slits in each wall 2*c*, 2*d*, is provided at a free end thereof with an engagement projection 11.

Figure 5:
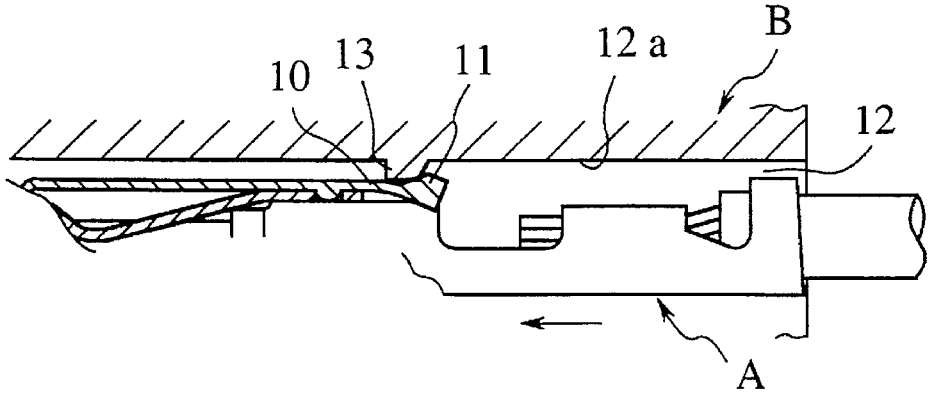
FIG. 5 is an explanatory view showing a condition under which the terminal of FIG. 1 is in process of being accommodated and engaged in a terminal receiving chamber of the connector housing.
Figure 6:
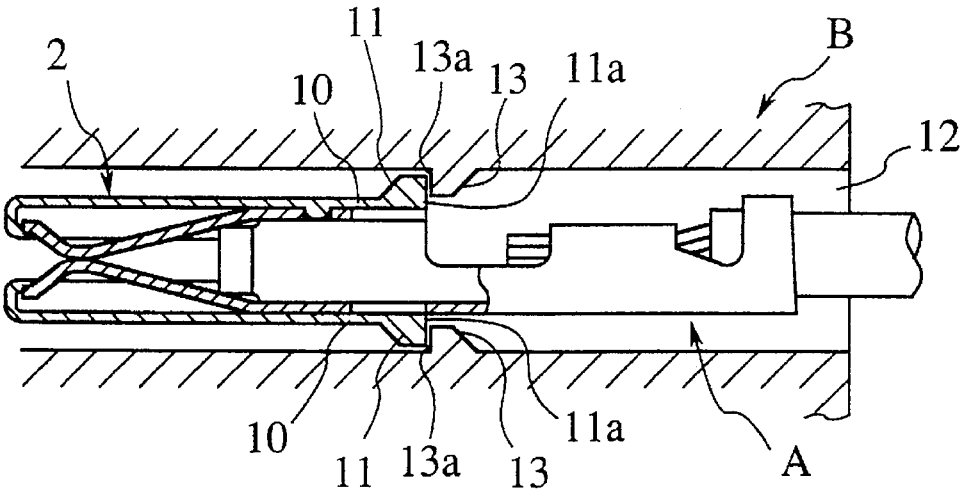
FIG. 6 is an explanatory view showing a condition under which the terminal of FIG. 5 is engaged in the terminal receiving chamber of the connector housing.

The operations of the engagement pieces 10 are now described with reference to FIGS. 5 and 6.

A connector housing B, which accommodates the terminal A therein, is provided on an inner wall 12*a* of a terminal receiving chamber 12 thereof with projections 13 which engage with the engagement pieces 10, respectively. In process of inserting the terminal A Into the terminal receiving chamber 12 to a direction of an arrow shown in FIG. 5, the engagement projections 11 of the flexible engagement pieces 10 are brought into contact with the projections 13 of the terminal receiving chamber 12, respectively and then elastically depressed due to the flexibility, so that the engagement projections 11 further intrude into the chamber 12, climbing over the projections 13.

Consequently, after climbing over each projection 13, each flexible engagement piece 10 returns to the original condition and simultaneously, the rear ends 11*a* of the engagement projections 11 abut against the front ends 13*a* of the projections 13, so that the terminal A is accommodated in the terminal receiving chamber 12.

As mentioned above, if only providing the projections 13 in the terminal receiving chamber 12, the terminal A can be easily engaged in the connector housing B. Therefore, with the arrangement mentioned above, the structure of the connector housing B can be simplified and miniaturized.

As a method of integrating the protective cover 2 with the terminal body 1, there is a method of press-fitting the terminal body 1 into the protective cover 2 on condition of forming it so that interior dimensions thereof are somewhat smaller than outside dimensions of the coupling portion 7 in advance.

Figure 7:
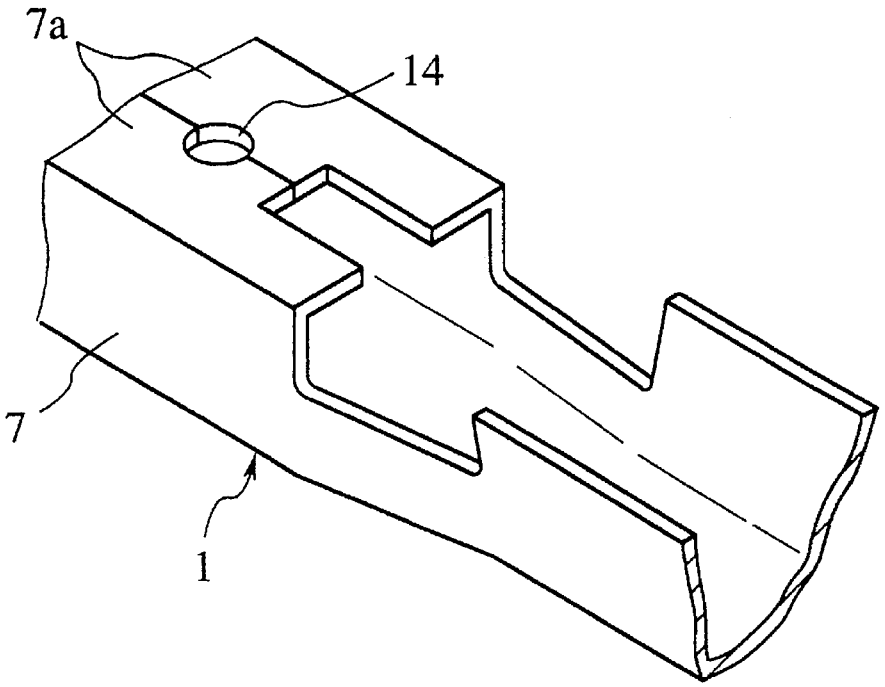
FIG. 7 is a partially perspective view of the terminal body of FIG. 1, showing means for engagement with the protective cover.
Figure 8:
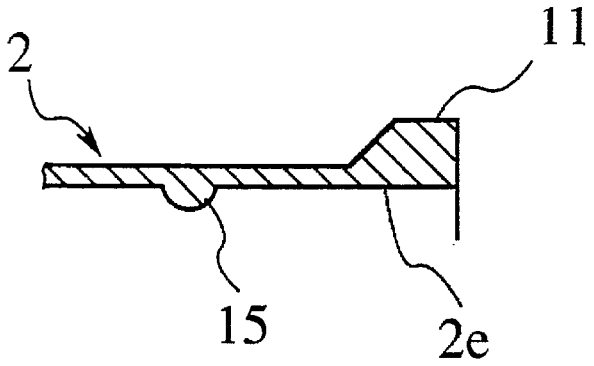
FIG. 8 is a partially cross sectional view of the protective cover to be engaged with the terminal body of FIG. 7, showing a protrusion.
Figure 9:
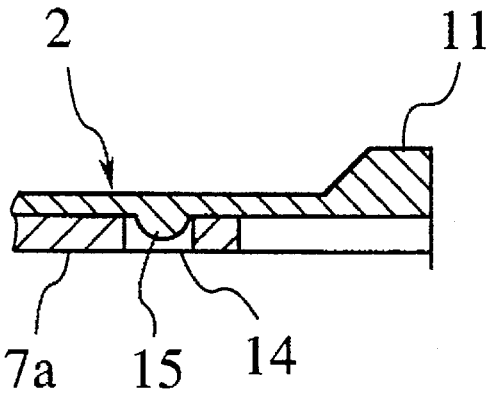
FIG. 9 is an explanatory view showing a condition under which the terminal body of FIG. 7 is engaged with the protective cover of FIG. 8.

In a modification, an aperture 14 is formed on the top wall 7*a* of the coupling portion 7 of the terminal body i as shown in FIG. 7 and an engagement protrusion 15 is provided on an inside wall 2*e* of the protective cover 2 as shown in FIG. 8. The protrusion 15 may be engaged in the aperture 14.

As mentioned above, according to the present invention, since the the flexible engagement piece is provided on the protective cover for covering the terminal body, the durability and reliability of the piece can be remarkably improved in comparison with the conventional flexible piece provided by raising a part of the terminal body, so that the terminal can be securely engaged with the terminal receiving chamber of the connector housing.

In addition, according to the invention, owing to the arrangement separated from the terminal body, it is possible to prevent the flexible engagement piece from being deformed by an external force caused in process of assembling the terminal with the connector housing or process of transporting the terminal body thereby, whereby a number of defective terminals can be reduced and the reliability can be improved.

Furthermore, since the structure of the terminal receiving chamber can be simplified corresponding to the simplified structure of the terminal of the present invention, the connector housing can be miniaturized and manufactured to be of high-density.

Finally, it will be understood by those skilled in the art that the forgoing description of the preferred embodiments of the disclosed structure, and that various changes and modifications may be made to the present invention without departing from the spirit and scope thereof.

What is claimed is:

1. An electrical terminal to be inserted into a terminal receiving chamber of a connector housing, said electrical terminal comprising:

a terminal body provided by folding a conductive metal plate, a protective cover arranged to cover said terminal body, said protective cover being made of insulating material and having one opening end through which said terminal body is to be inserted, and at least one flexible engagement piece defined by two parallel slits which are formed on said protective cover to terminate at said one opening end of said protective cover, said one flexible engagement piece having an engagement projection by which said electrical terminal can be engaged in said connector housing.

2. An electrical terminal as claimed in claim 1, wherein said terminal body comprises an electrical contact portion consisting of opposing elastic pieces and wherein said electrical contact portion is covered with said protective cover.

3. An electrical terminal as claimed in claim 2, further comprising another flexible engagement piece defined by two parallel slits which are also formed on said protective cover to terminate at said one opening end of said protective cover, said another flexible engagement piece having another engagement protection by which said electrical terminal can be engaged in said connector housing, wherein said one and another engagement pieces are positioned on top and bottom walls of said protective cover, respectively.

4. An electrical terminal as claimed in claim 3, wherein said protective cover is provided with an opening through which an engagement terminal is to be inserted into said electrical contact portion.

5. An electrical terminal as claimed in claim 4, wherein said protective cover is provided on an interior wall thereof with a protrusion and said terminal body is provided with an aperture for engagement with said protrusion.

6. An electrical terminal as claimed in claim 5, wherein said protective cover is made of synthetic resin.

* * * * *